US006829821B1

(12) United States Patent
Hellemans

(10) Patent No.: US 6,829,821 B1
(45) Date of Patent: Dec. 14, 2004

(54) CRIMPING UNIT AND METHOD OF CRIMPING FLAT CABLES

(76) Inventor: Roel Hellemans, Au Coucou, 32200 Montiron (FR)

( * ) Notice: Subject to any disclaimer, the term of this patent is extended or adjusted under 35 U.S.C. 154(b) by 0 days.

(21) Appl. No.: 09/868,567

(22) PCT Filed: Dec. 20, 1999

(86) PCT No.: PCT/EP99/10119

§ 371 (c)(1),
(2), (4) Date: Jun. 15, 2001

(87) PCT Pub. No.: WO00/39899

PCT Pub. Date: Jul. 6, 2000

(30) Foreign Application Priority Data

Dec. 23, 1998 (FR) ..... 98 16332

(51) Int. Cl.[7] ..... H01R 43/04

(52) U.S. Cl. ..... 29/753; 29/33 F; 29/747; 29/748; 29/749; 29/861; 29/863; 72/451; 72/409.14

(58) Field of Search ..... 29/33 F, 753, 29/747, 751, 761, 763, 748, 749, 33 M, 863–867, 861, 564.4; 72/451, 712, 409.14, 412–416, 337, 461; 100/282; 7/107; 198/346.2, 468.2

(56) References Cited

U.S. PATENT DOCUMENTS 4,110,880 A * 9/1978 Peppler et al. ..... 29/33 K
4,126,935 A 11/1978 Rhines et al.
4,217,977 A 8/1980 Tam
4,403,407 A * 9/1983 Mazzola ..... 29/749
4,862,787 A * 9/1989 Suzuki et al. ..... 91/369.2
6,425,473 B1 * 7/2002 Meisser et al. ..... 198/346.2

FOREIGN PATENT DOCUMENTS

| | | |
|---|---|---|
| DE | 9307220.1 | 10/1993 |
| EP | 0167985 A2 | 1/1985 |
| EP | 0413655 A2 | 2/1991 |

* cited by examiner

*Primary Examiner*—Minh Trinh
(74) *Attorney, Agent, or Firm*—Laurence A. Greenberg; Werner H. Stemer; Gregory L. Mayback

(57) ABSTRACT

A unit for automatically crimping ribbons of flexible flat cable has a guide surface on which a ribbon of flat cable travels. A number of crimping stations are arranged vertically offset plumb with the plane of the guide surface and designed to crimp a connector onto an end of a branch of the flat cable. A number of tilting ramps have a first end even with the plane of the guide surface when they are in the tilted state and a second end even with a crimping station. The ramp tilts toward the guide surface on command so that a predetermined branch of the ribbon follows the ramp it encounters in its path as it travels along and so that it is directed to one travels along and so that it is directed to one of the crimping stations where it receives a connector.

7 Claims, 1 Drawing Sheet

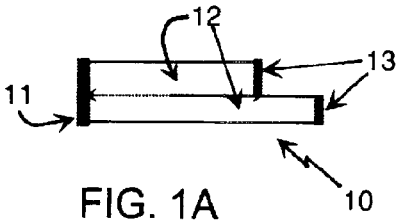
FIG. 1A
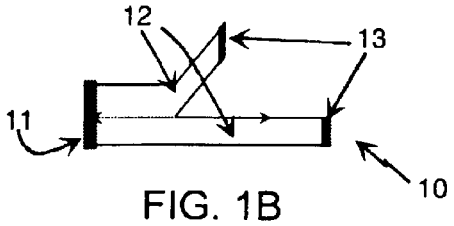
FIG. 1B
FIG. 2
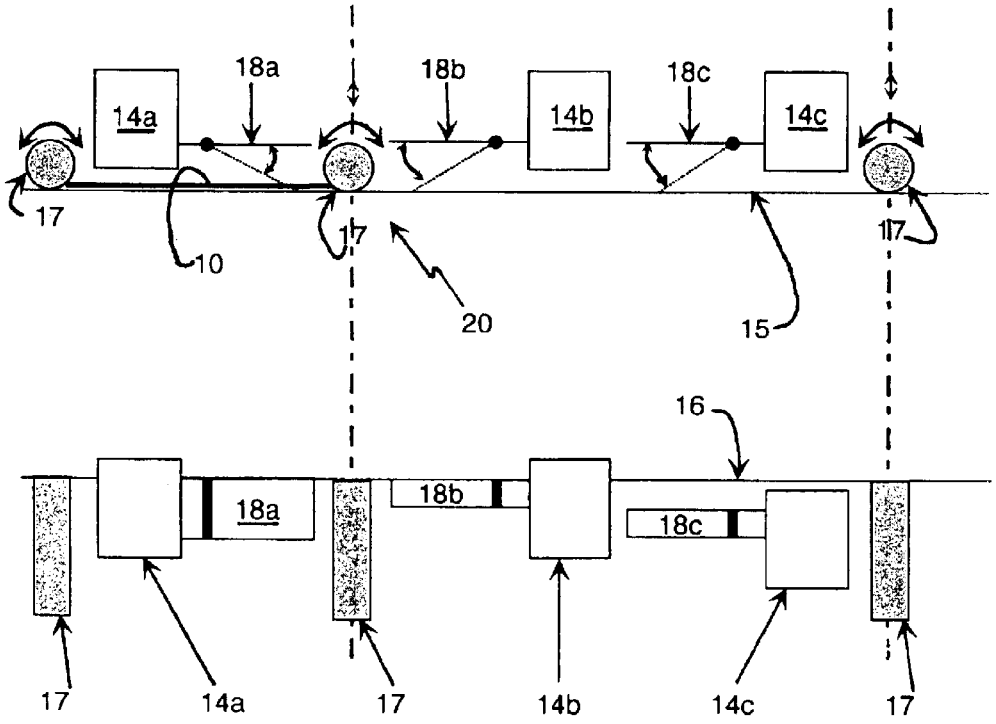
FIG. 3

CRIMPING UNIT AND METHOD OF CRIMPING FLAT CABLES

BACKGROUND OF THE INVENTION

FIELD OF THE INVENTION

The present invention relates to a unit for automatically crimping ribbons of flexible flat cable and to a corresponding crimping process.

It is already known practice for very long flat cables to be used to make electrical connections inside a motor vehicle. These flat cables have the advantage of being of small thickness and therefore being able to be slipped behind the interior trim of the vehicle without ruining its appearance. Furthermore, flat cables are lighter in weight than round cables and are less expensive. Of course, just like the round cables (that they replace), they are fitted with connectors at the end of each of their branches.

The crimping of these connectors is a lengthy and tricky operation. Because of the complexity of the bundles of cables, this crimping is often done manually. The branch that is to be crimped is commonly placed in the crimping machine by an operator. This leads to inevitable assembly errors, and very few cable bundles are produced correctly first off. Such a method of performing the crimping entails setting up systematic checks of each bundle, which correspondingly increases the manufacturing time.

SUMMARY OF THE INVENTION

The object of the present invention is to create a crimping unit in which the branch to be crimped is placed automatically in the crimping station. The desire is also to guarantee that the branches placed in a crimping station are always the right ones. This makes it possible to reduce the amount of checking to be performed and reduces the time taken to manufacture the ribbon of flat cable.

To this end, the present invention relates to a unit for automatically crimping ribbons of flexible flat cable, said ribbon comprising at least one branch onto which a connector is to be crimped, said unit being characterized in that it comprises:

- a guide surface on which the ribbon of flat cable travels,
- a number of crimping stations arranged vertically offset plumb with the plane of the guide surface and designed to crimp a connector onto the end of a branch, and
- a number of tilting ramps which have a first end even with the plane of the guide surface when they are in the tilted state and a second end even with a crimping station, said ramp being arranged in the opposite direction to the direction of travel of the ribbon, each ramp being designed to tilt toward the guide surface on command so that a predetermined branch of the ribbon follows the ramp it encounters in its path as it travels along and so that it is directed to one of the crimping stations where it receives a connector.

Advantageously, the tilting of the ramp makes it possible to guarantee that only that branch of the ribbon that faces this ramp will be led up to the corresponding crimping station. According to the invention, there is no need to provide a specific means for driving the branch that is to be crimped because the ribbon is rigid enough that the branch for crimping will be driven along at the same time as the ribbon itself.

Of course, the ramps that lead each of the branches for crimping up to a crimping station will have a greater or lesser width according to the configuration of the ribbon of flat cable to be produced. This is because sometimes the branch for crimping contains just two tracks, and sometimes it contains a great many (some ten or so) tracks. In this case, the width of the ramp is tailored each time so that all of the tracks constituting the branch for crimping are directed to the crimping station. In consequence, the ramps according to the invention do not all have the same width. Furthermore, the width of each ramp can be changed according to the ribbon to be produced. To this end, each crimping station has a set of ramps of varying widths. Each time a run of ribbons is to be produced, the appropriate ramps are placed in front of each crimping station.

Advantageously, the tilting of a ramp can be programmed with respect to time. The various connectors can be placed one after another on each of the branches or may be crimped at the same time.

Other objects, features and advantages of the present invention will in any case become apparent from the description which follows, by way of nonlimiting example, with reference to the appended drawings in which:

BRIEF DESCRIPTION OF THE DRAWINGS

FIGS. 1*a* and 1*b* are schematic views showing a ribbon of flat cable onto which connectors are to be crimped, FIG. 2 is a schematic side view of a crimping unit according to the invention, and FIG. 3 is a schematic view from above of the crimping unit according to FIG. 2.

DESCRIPTION OF THE PREFERRED EMBODIMENT

FIGS. 1*a* and 1*b* show a ribbon 10 of flat cable to be crimped. For the purposes of the description, this ribbon of flat cable is extremely simple because it consists of four tracks held together in a common connector 11 (to the left in the drawing). This ribbon splits into two branches 12 of different lengths, each consisting of two tracks. A connector 13 is placed at the end of each of these branches.

As FIG. 1*b* shows, these branches are intended to adopt different directions by folding and to supply accessories placed in the vehicle at different points.

The connector crimping unit 20 for producing such a ribbon 10 is depicted in FIGS. 2 and 3.

This unit comprises three crimping stations 14*a*, 14*b*, 14*c*(in the particular embodiment of the ribbon depicted in FIG. 2). Of course, the number of crimping stations may vary according to the configuration of the branches to be crimped.

The crimping unit also comprises a guide surface 15 on which the ribbon of flat cable 10 is placed. This ribbon of flat cable is driven along a guide rail 16. The means of moving the ribbon consist of rollers 17 which can be rotated in two directions of rotation (clockwise and counterclockwise). The ribbon is driven by the friction of the rollers on the ribbon, which causes this ribbon to move to the right or to the left (in the drawing), that is to say in two opposite directions of travel.

Each crimping station is placed above the ribbon (vertically offset), so that a tilting ramp 18*a*, 18*b*, 18*c*associated with it is plumb with the tracks of the branch on which it is to affix a connector.

In the state of rest, the tilting ramps 18*a*, b and c are in the position depicted in solid line in FIG. 2. The ribbon is therefore driven by the rollers 17 and travels unimpeded under the crimping stations 14*a, b, c.*

The automatic crimping process according to the invention is described hereinafter.

First of all, the common connector 11 is crimped on. To do this, the ribbon 10 is brought with the aid of the rollers 17 so that its left-hand end is to the right of the tilting ramp 18*a*. The tilting (dotted line, FIG. 2) of the ramp 18*a* toward the guide surface is then commanded. Thus, a first end of this ramp is positioned even with the guide surface 15 (in contact with this surface), while a second end of the ramp 18*a* is even with the crimping station 14*a*. The rollers 17 are then rotated so that the ribbon 10 is driven to the left. As the ramp 18*a* is inclined in the opposite direction to the direction of travel of the ribbon, this ribbon is deflected and directed to the crimping station. As soon as the ribbon 10 is detected as being in place in the crimping station 14*a*, the common connector 11 is crimped onto the end of the ribbon. Once the connector has been crimped on, the rollers 17 drive the ribbon 10 in the opposite direction (that is to say to the right in the drawing) so that the ribbon travels back down from the crimping station 14*a*. As soon as the ribbon is resting fully on the guide surface 15, the tilting ramp 18*a* is raised back to the position of rest.

The connectors 13 to be placed at the ends of the branches 12 are then fitted in a similar way, by commanding the tilting of Ago the ramps 18*b* then 18*c* and by driving the ribbon in the appropriate direction using the rollers 17.

It will be noted that when the ribbon 10 is equipped with at least one connector and it is necessary for this ribbon to be moved, some of the rollers 17 could damage the connector(s) already fitted. To avoid that, the rollers 17 can retract vertically. This retraction may be programmed. Thus, the rollers 17 do not damage the connectors already fitted as they are driving the ribbon along.

The crimping process according to the present invention consists in:

driving a ribbon of flat cable along a guide surface, commanding the tilting of at least one tilting ramp so that at least one branch of the ribbon follows the tilted ramp and is directed to a corresponding crimping station, and crimping a connector onto the branch when its presence in a crimping station is detected.

Of course, the present invention is not restricted to the embodiment described above. Hence, the crimping unit according to the present invention may have a number of crimping stations and a number of associated tilting ramps, this being according to the configuration of the branches to be crimped.

What is claimed is:

1. A crimping unit for automatically crimping ribbons of flexible flat cable, the unit comprising:

a guide surface having a guide surface plane for guiding a ribbon of flat cable;

a plurality of crimping stations arranged vertically offset from said guide surface plane for crimping a connector onto an end of a branch of the ribbon; and a plurality of tilting ramps each having a first end and a second end, and each being mounted to be tiltable towards said guide surface whereby said first end is brought into said guide surface plane and whereby said second end is even with a respective said crimping station, and wherein, when a respective said ramp is tilted toward said guide surface on command, a predetermined branch of the ribbon follows the ramp and travels to a respective said crimping station and receives the connector.

2. The crimping unit according to claim 1, wherein each said ramp is associated with a given said crimping station for guiding a branch of the ribbon of flat cable to said crimping station for crimping.

3. The crimping unit according to claim 1, wherein said guide surface drives the ribbon in two opposite directions of travel.

4. The crimping unit according to claim 1, which comprises a plurality of rollers having two directions of rotation, wherein the ribbon of flat cable is driven along said guide surface by said rollers.

5. The crimping unit according to claim 4, wherein said rollers driving the ribbon are vertically retractable for preventing damage to the connectors crimped onto the ribbon.

6. A crimping process for crimping connectors onto branches of ribbons of flexible flat cable, which comprises:

providing the crimping unit according to claim 1;

driving a ribbon of flat cable along a guide surface of the crimping unit;

issuing a command for tilting at least one tilting ramp for guiding at least one branch of the ribbon along the tilted ramp to a corresponding crimping station; and crimping a connector onto the branch in the crimping station.

7. The method according to claim 6, which comprises crimping the connector onto the branch upon detecting a presence of an end of the branch in the crimping station.

* * * * *